US008323045B2

(12) United States Patent
Kato

(10) Patent No.: US 8,323,045 B2
(45) Date of Patent: Dec. 4, 2012

(54) CARD EDGE CONNECTOR

(75) Inventor: Rintaro Kato, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 184 days.

(21) Appl. No.: 12/807,735

(22) Filed: Sep. 13, 2010

(65) Prior Publication Data

US 2011/0111614 A1 May 12, 2011

(30) Foreign Application Priority Data

Nov. 6, 2009 (JP) ..... 2009-254987

(51) Int. Cl.
*H01R 13/625* (2006.01)

(52) U.S. Cl. ..... 439/326

(58) Field of Classification Search ..... 439/326
See application file for complete search history.

(56) References Cited

U.S. PATENT DOCUMENTS

| | | | | |
|---|---|---|---|---|
| 5,641,295 | A | 6/1997 | Koyama | |
| 6,176,725 | B1 | 1/2001 | Kobayashi et al. | |
| 6,634,899 | B2 | 10/2003 | Takahiro et al. | |
| 6,743,028 | B2 * | 6/2004 | Wang | 439/92 |
| 7,074,067 | B2 * | 7/2006 | Yang et al. | 439/326 |
| 7,789,692 | B2 * | 9/2010 | Lee | 439/327 |

FOREIGN PATENT DOCUMENTS

| | | |
|---|---|---|
| JP | 3-015081 | 6/1995 |
| JP | 08-190967 | 7/1996 |
| JP | 10-294147 | 11/1998 |
| JP | 2000-208183 | 7/2000 |
| JP | 3-730116 | 10/2005 |

OTHER PUBLICATIONS

Japanese Office Action dated Jul. 14, 2011 in Japanese Application No. 2009-254987 with an English translation of same.

* cited by examiner

*Primary Examiner* — Neil Abrams
(74) *Attorney, Agent, or Firm* — Collard & Roe, P.C.

(57) ABSTRACT

A card edge connector has a plurality of contacts, a housing configured to hold the plurality of contacts arranged in a first direction, and a pair of arm members held on the housing so as to extend along a second direction perpendicular to the first direction. Each of the arm members includes a latch portion and an interference portion. The latch portion is configured to engage with a side edge of a card when the card is connected to the card edge connector. The interference portion is configured to interfere with the side edge of the card in the first direction so as to prevent the latch portion from engaging with the side edge of the card when the card is improperly connected to the card edge connector. The interference portion projects inwardly in the first direction beyond the latch portion.

7 Claims, 5 Drawing Sheets

CARD EDGE CONNECTOR

CROSS REFERENCE TO RELATED APPLICATIONS

Applicant claims priority under 35 U.S.C. §119 of Japanese Patent Application No. JP2009-254987 filed Nov. 6, 2009.

BACKGROUND OF THE INVENTION

The present invention relates to a card edge connector or socket connectable to a card having terminals near an edge thereof, such as a memory module.

With this type of card connectors, a connection edge of a small card is inserted obliquely downward into an opening portion of the card edge connector mounted and fixed on a circuit board such as a motherboard. Then the card is rotated into a horizontal position so as to bring a connection portion formed on the connection edge of the card into contact with contacts of the card edge connector. At that time, latch portions provided on the arm members of the card edge connector engage with side edges of the card so as to maintain the connected state of the card edge connector and the card. For example, this type of card connectors is disclosed in JP-B 3730116, JP-A 1998-294147, and JP-Y 3015081.

In a conventional card edge connector, latch portions may be latched on side edges of a card even if the card is not properly connected to the card edge connector.

SUMMARY OF THE INVENTION

It is therefore an object of the present invention to provide a card edge connector capable of preventing latch portions from being latched on side edges of a card when the card is improperly connected to the card edge connector.

One aspect of the present invention provides a card edge connector having a plurality of contacts, a housing configured to hold the plurality of contacts arranged in a first direction, and a pair of arm members held on the housing so as to extend along a second direction perpendicular to the first direction. Each of the arm members includes a latch portion and an interference portion. The latch portion configured to engage with a side edge of a card when the card is connected to the card edge connector. The interference portion is configured to interfere with the side edge of the card in the first direction so as to prevent the latch portion from engaging with the side edge of the card when the card is improperly connected to the card edge connector. The interference portion projects inwardly in the first direction beyond the latch portion.

An appreciation of the objectives of the present invention and a more complete understanding of its structure may be had by studying the following description of the preferred embodiment and by referring to the accompanying drawings.

Figure 1:
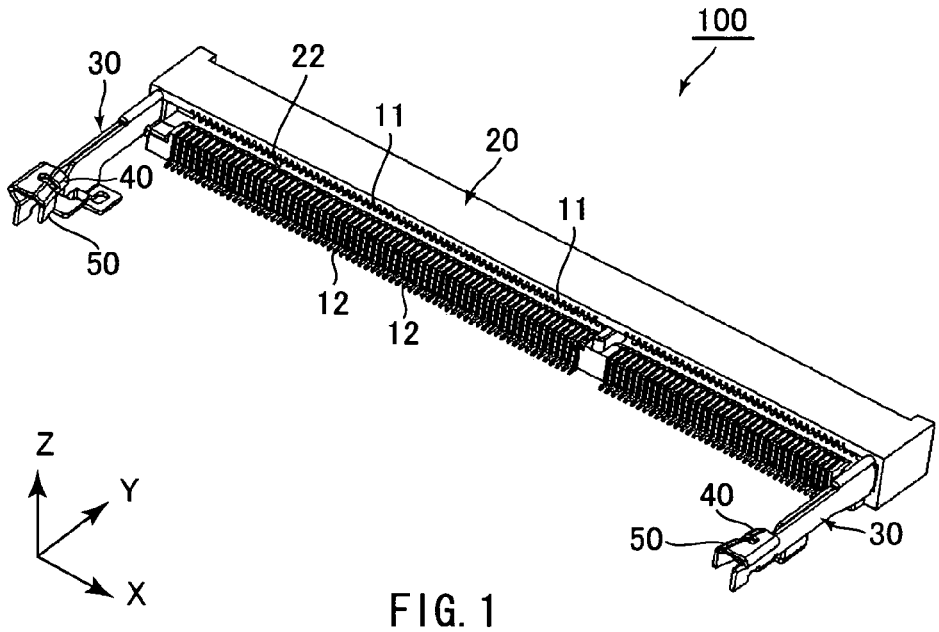
FIG. 1 is a perspective front view showing a card edge connector according to an embodiment of the present invention.
Figure 2:
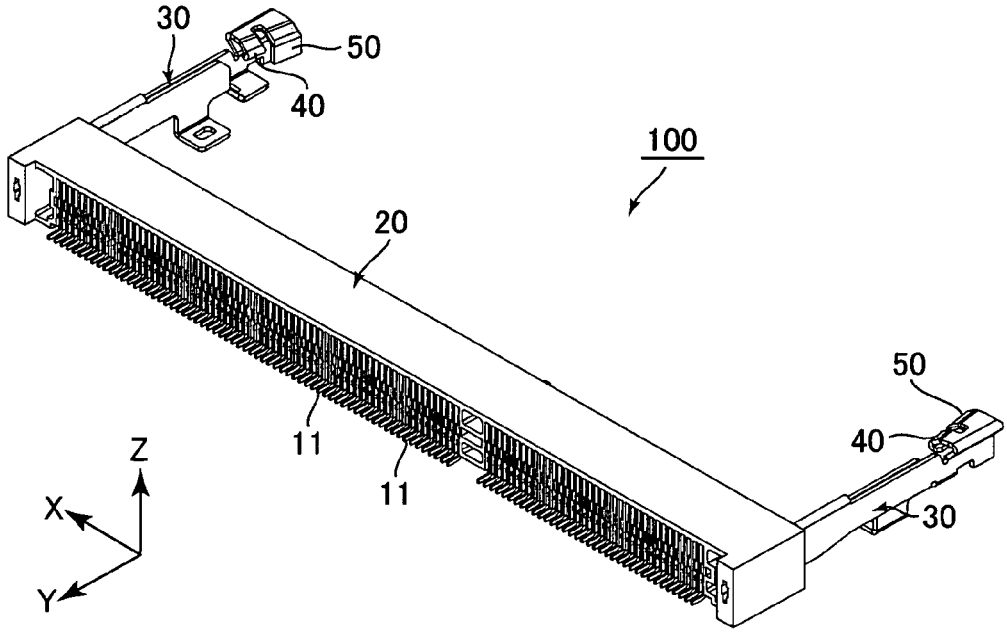
FIG. 2 is a perspective rear view showing the card edge connector of FIG. 1.
Figure 3:
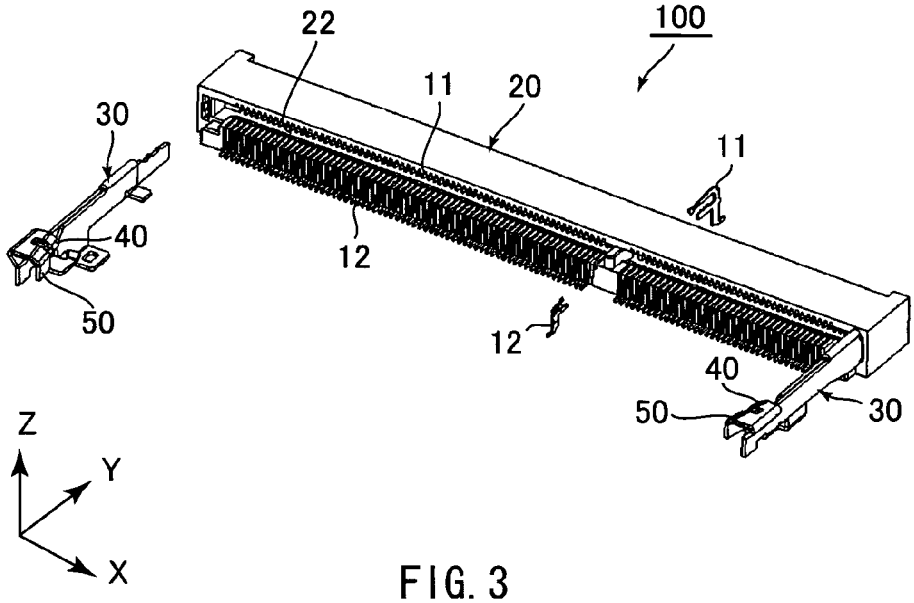
FIG. 3 is a perspective exploded view showing the card edge connector of FIG. 1.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Referring to FIGS. 1 to 4, 6, and 7, a card edge connector 100 according to an embodiment of the present invention is fixed on a relatively large circuit board such as a motherboard. The card edge connector 100 is connectable to a card 200 having a plurality of semiconductor packages 250 mounted on a relatively small circuit board. The card 200 of this embodiment has a memory module as a connection target. The card 200 includes a plurality of DRAM packages (semiconductor packages) mounted thereon. The card 200 has a plurality of terminals provided on its leading edge (connection edge) for establishing connection with the card edge connector 100. The card 200 has semicircular notches 212 formed in side edges 210 thereof.

The card edge connector 100 has a plurality of upper contacts 11 and a plurality of lower contacts 12. The card edge connector 100 also has a housing 20 configured to hold the upper contacts 11 arranged in the X-direction (first direction) and hold the lower contacts 12 arranged in the X-direction. The card edge connector 100 has a pair of arm members 30 extending along the Y-direction (second direction) from opposite ends of the housing 20 in the X-direction. The housing 20 extends along the X-direction. The housing 20 is made of an insulating material. The housing 20 has an opening portion 22 formed therein. The upper contacts 11 and the lower contacts 12 are held by the housing 20 in a state where the upper contacts 11 and the lower contacts 12 are partially exposed within the opening portion 22. When the card 200 is connected to the card edge connector 100, the connection edge of the card 200 is inserted obliquely downward into the opening portion 22. Then the card 200 is rotated into a horizontal position. Thus, the terminals formed on the connection edge of the card 200 can be brought into contact with the upper contacts 11 and the lower contacts 12 of the card edge connector 100. Each of the arm members 30 has a latch portion 40. When the card 200 is properly connected to the card edge connector 100 (i.e. when the card 200 is properly mated with the card edge connector and is in a complete mating state), the latch portions 40 engage with the side edges 210 of the card 200 so that the connected state is maintained.

Figure 5:
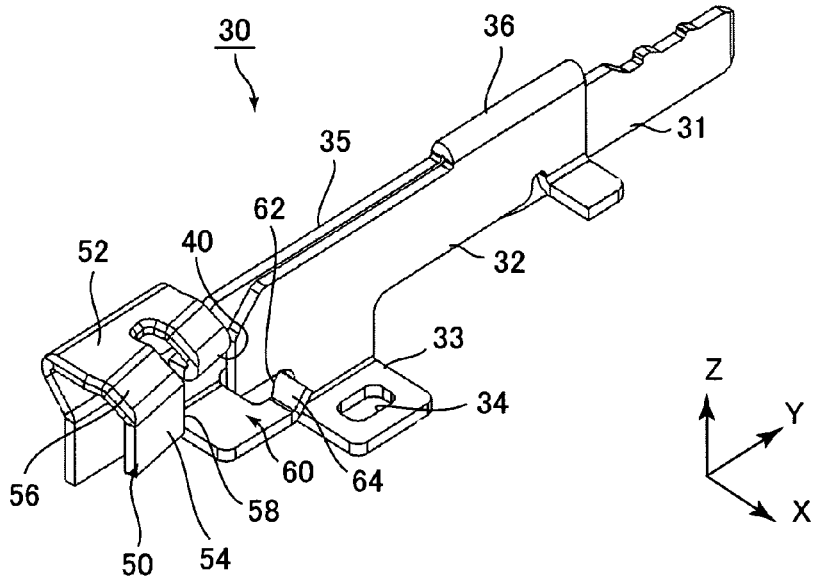
FIG. 5 is a perspective view showing an arm member included in the card edge connector of FIG. 1.
Figure 6:
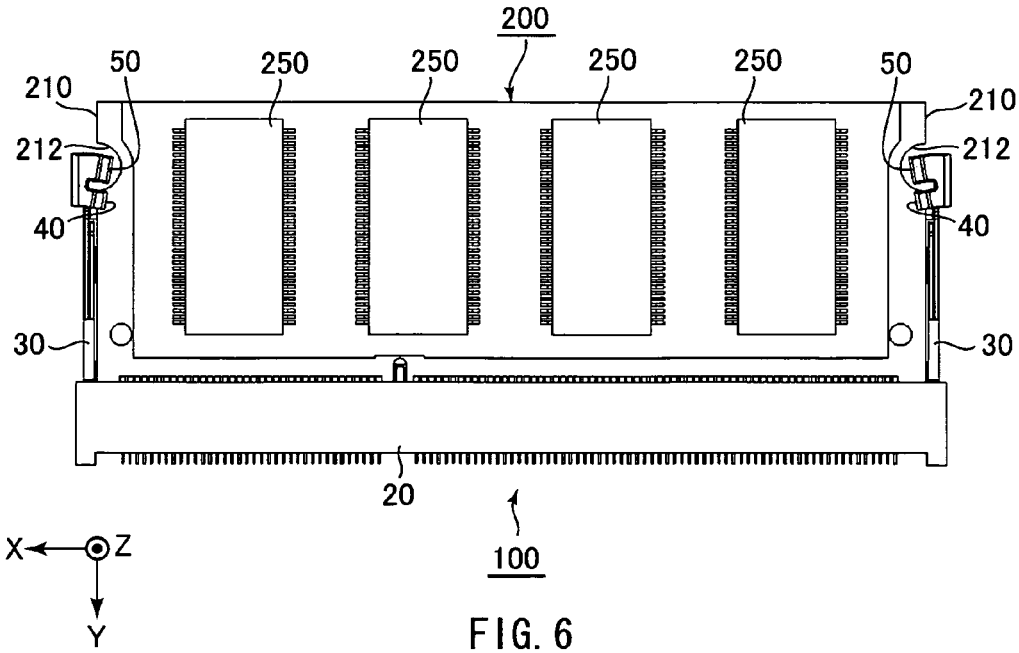
FIG. 6 is a plan view showing that a memory card is attached to the card edge connector of FIG. 1.
Figure 7:
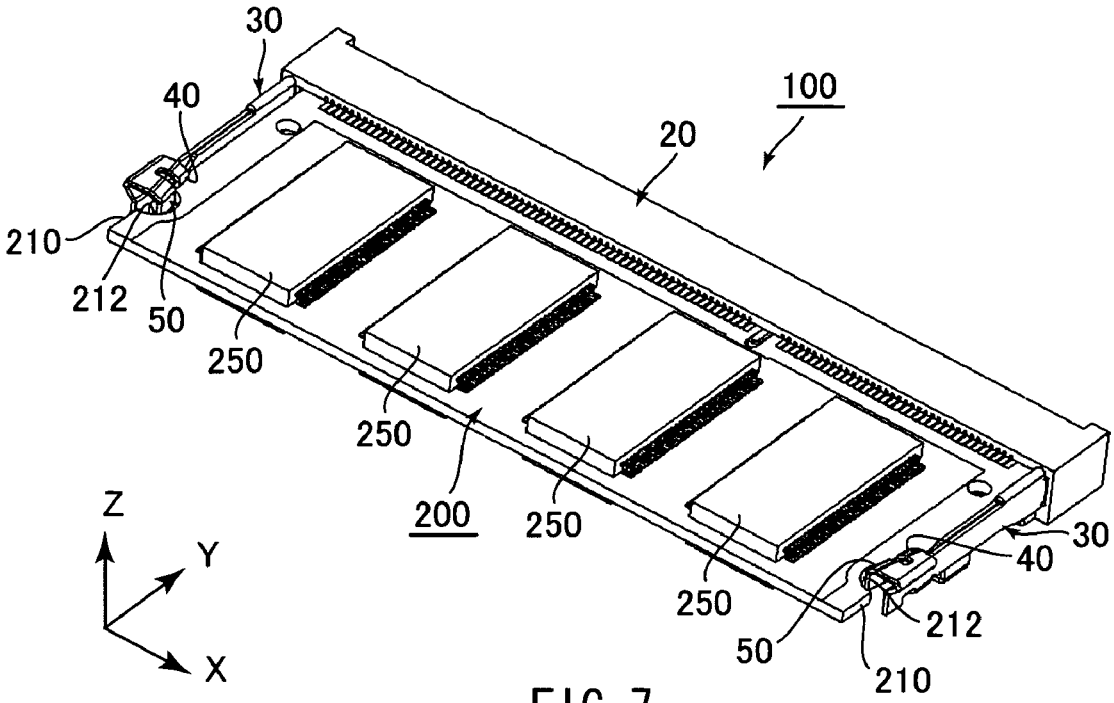
FIG. 7 is a perspective view showing that the memory card is attached to the card edge connector of FIG. 1.

As shown in FIG. 5, the arm members 30 of this embodiment are produced by punching a sheet metal and bending the punched sheet metal. Each of the arm members 30 includes a press-fit portion 31, a fixing portion 32, a spring portion 35, the latch portion 40, an interference portion 50, and a regulation portion 60. The press-fit portion 31 is fitted into an end of the housing 20 in the X-direction. The fixing portion 32 fixes the arm member 30 onto the circuit board such as a motherboard. The spring portion 35 is formed such that the spring portion 35 can elastically be deformed outward in the X-direction. The latch portion 40, the interference portion 50, and the regulation portion 60 are supported on the spring portion 35 such that they are deformable.

The fixing portion 32 has a tabular SMT portion 33 having a hole 34 formed therein. The SMT portion 33 is soldered to a pad (not shown) of the circuit board to thereby fix the arm member 30 on the circuit board. A screw may be threaded into the hole 34 so as to fix the fixing portion 32 more firmly to the circuit board. The fixing portion 32 is connected to the spring portion 35 via a connection portion 36. Specifically, the fixing portion 32 and the spring portion 35 include bases extending in parallel to the YZ-plane, respectively. The connection portion 36 connects an upper edge of the base of the spring portion 35 to an upper edge of the base of the fixing portion 32 near the press-fit portion 31. According to this embodiment, the latch portion 40, the interference portion 50, and the regulation portion 60 are formed on an end of the spring portion 35 and located roughly beyond an end of the fixing portion 32 in the Y-direction.

Figure 4:
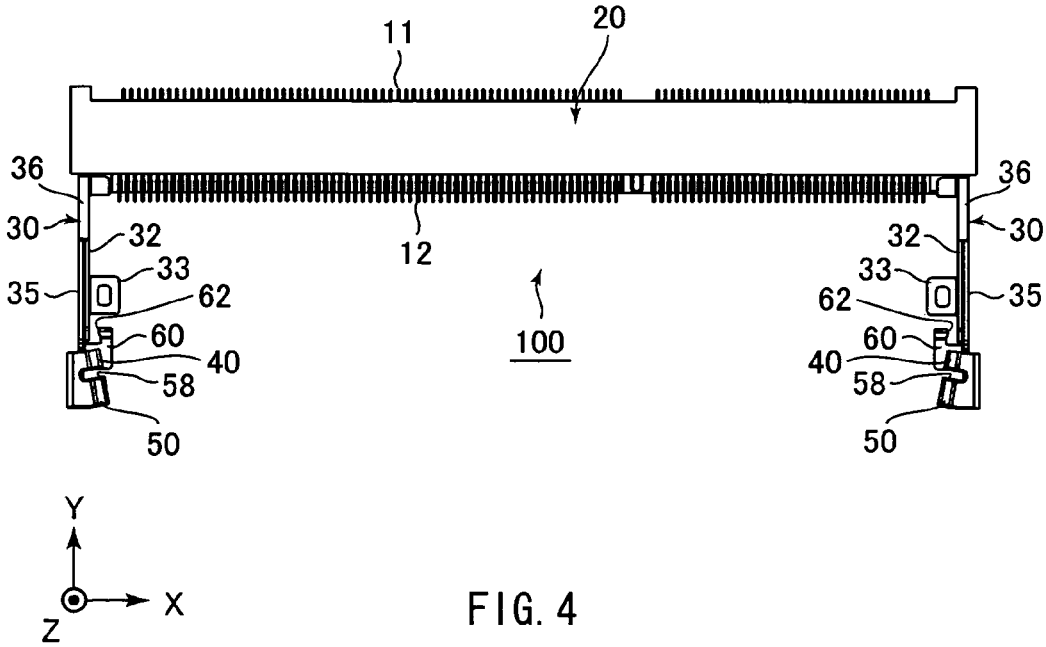
FIG. 4 is a plan view showing the card edge connector of FIG. 1.

Referring to FIGS. 4 and 5, the latch portions 40 engage with the side edges 210 of the card 200 when the card 200 is properly connected to the card edge connector 100. Thus, the latch portions 40 maintain the connected state of the card 200 and the card edge connector 100. Each of the latch portions 40 projects from the spring portion 35 toward an inner area of the card edge connector 100 in the X-direction.

Each of the interference portions 50 also projects from the spring portion 35 toward the inner area of the card edge connector 100 in the X-direction. The interference portions 50 of this embodiment project from the spring portions 35 toward the inner area of the card edge connector 100 in the X-direction (toward the center of the card edge connector 100 in the X-direction) longer than the latch portions 40. Specifically, as shown in FIG. 4, a distance between the interference portions 50 is shorter than a distance between the latch portions 40 in the X-direction in this embodiment. When the card 200 is improperly connected to the card edge connector 100, the interference portions 50 interfere with the side edges 210 of the card 200 in the X-direction to thereby prevent the latch portions 40 from engaging with the side edges 210 of the card 200. In other words, when the card 200 is properly connected to the card edge connector 100, the interference portions 50 do not prevent engagement of the latch portions 40 with the side edges 210 of the card 200. In the present embodiment, the latch portions 40 and the interference portions 50 are located at different positions in the Y-direction. More specifically, each of the latch portions 40 is located between the interference portion 50 and the housing 20 in the Y-direction.

Figure 8:
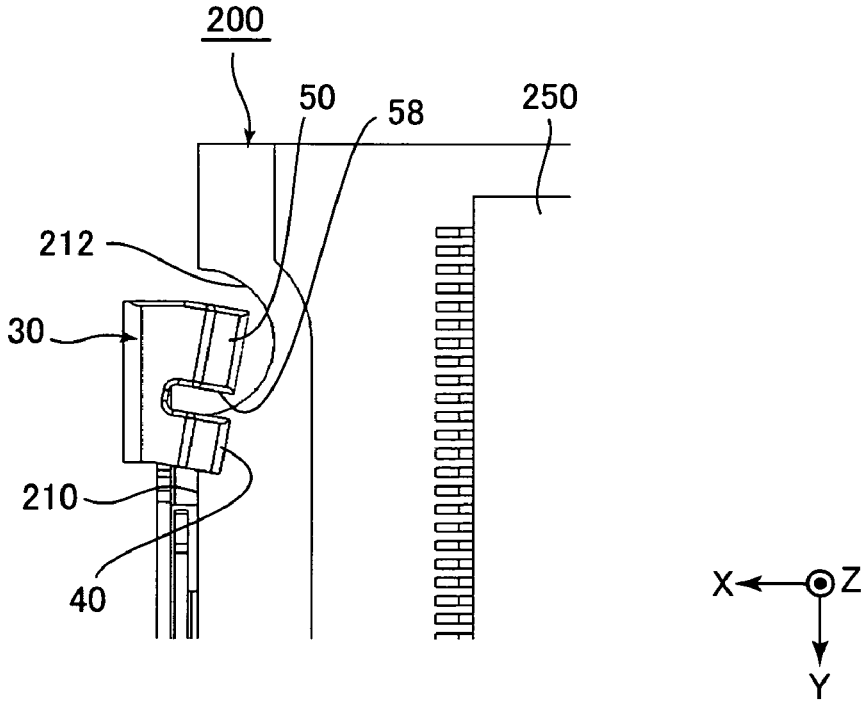
FIG. 8 is an enlarged plan view showing an end of the arm member of the card edge connector of FIG. 1. The memory card is properly attached to and latched on the card edge connector.
Figure 9:
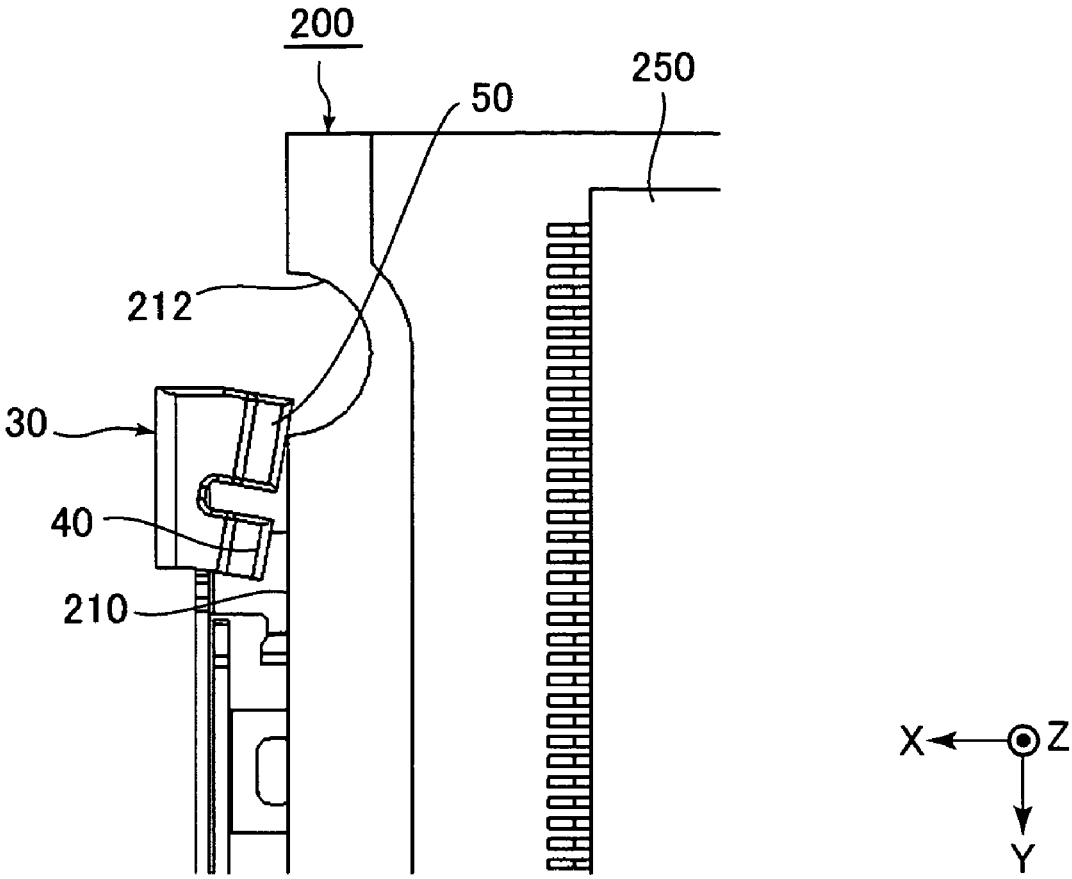
FIG. 9 is an enlarged plan view showing the end of the arm member of the card edge connector of FIG. 1. The memory card is not properly attached to the card edge connector and is not latched on the card edge connector.

As described above, the card 200, which is a connection target of this embodiment, has semicircular notches 212 formed in the side edges 210 (see FIGS. 6 to 9). Each of the notches 212 is recessed in the X-direction when the card 200 is properly connected to the card edge connector 100. When the card 200 is properly connected to the card edge connector 100, the interference portions 50 are located within the notches 212, respectively, as shown in FIG. 8. At that time, the latch portions 40 can engage with the side edges 210 of the card 200. Thus, the connected state of the card 200 and the card edge connector 100 can properly be maintained. When the card 200 is improperly connected to the card edge connector 100 (in a half-mated state or a half-connected state), the interference portions 50 are not located within the notches 212 as shown in FIG. 9. Thus, the interference portions 50 interfere with the side edges 210 of the card 200. When the interference portions 50 interfere with the side edges 210, the latch portions 40 cannot engage with the side edges 210 of the card 200 because the latch portions 40 are located outside of the respective interference portions 50 in the X-direction. Therefore, with the card edge connector 100 according to the present embodiment, the latch portions 40 cannot engage with the side edges 210 in the half-mated state of the card 200 and the card edge connector 100.

The interference portions 50 of this embodiment are produced by bending a punched sheet metal. Each of the interference portions 50 includes a base portion 52 extending in parallel to the XY-plane, a piece 54 extending in a direction oblique to both of the X-direction and the Y-direction, and a bent portion 56 interconnecting the base portion 52 and the piece 54. Specifically, the interference portion 50 is produced by bending a sheet metal about an axis extending in a direction that is perpendicular to the Z-direction and is oblique to both of the X-direction and the Y-direction. Particularly, in the present embodiment, a sheet metal is bent so as to generate a bending line extending in parallel to the aforementioned axis although the bending line is not clear because the interference portion 50 has a rounded surface.

Although a lower edge of the piece 54 of the interference portion 50 does not extend in the Z-direction, a side edge of the piece 54 of the interference portion 50 near the housing 20 extends in the Z-direction. The near side edge serves as a removal prevention portion 58. When the card 200 is removed forcibly along the negative Y-direction in a state where the card 200 is properly connected to the card edge connector 100, the removal prevention portion 58 interferes with the card 200 to prevent a forced removal of the card 200. The forced removal refers to removal of the card without disengagement of the latch portions in the properly connected state. The removal prevention portions 58 thus configured have higher strength than conventional removal prevention portions. For example, removal prevention portions disclosed in JP-B 3730116 are produced by bending a sheet metal about an axis extending in parallel to the Z-direction. Therefore, if a force is applied to the removal prevention portions by forced removal of a card, the removal prevention portions may be deformed (or stretched) outward. In contrast, the removal prevention portions 58 of this embodiment are formed, respectively, by parts of the side edges of the interference portions 50 of the arm members 30. Therefore, even if a relatively large force is applied to the removal prevention portions 58 when the card 200 is forcibly removed, the removal prevention portions 58 can reliably receive that force.

As described above, each of the interference portions 50 includes the base portion 52 extending in parallel to the XY-plane and the piece 54 extending in the direction that is oblique to both of the X-direction and the Y-direction. However, the present invention is not limited to this example. For example, the base portion 52 may extend in a direction that is oblique to both of the X-direction and the Y-direction, and the piece 54 may extend in a direction that is oblique to the X-direction, the Y-direction, and the Z-direction, under the condition that a side edge of the interference portion 50, not a surface or a leading edge of the piece 54, is used as the removal prevention portion 58. Furthermore, although the removal prevention portions 58 are provided on the interference portions 50 in the present embodiment, the removal prevention portions 58 may be separated from the interference portions 50. In consideration of the size of the entire card edge connector 100 and the like, however, it is preferable to provide the removal prevention portions 58 on the interference portions 50 as in the present embodiment.

Each of the regulation portions 60 of this embodiment is produced by bending a part of the spring portion 35. The regulation portions 60 extend inward along the X-direction from the parts of the spring portions 35 (lower edges of the spring portions 35 in the present embodiment), respectively. The regulation portions 60 prevent the spring portions 35 from being excessively deformed outward in the X-direction. Each of the regulation portions 60 has a contact portion 62 on a side edge of the regulation portion 60 facing the fixing portion 32. When the spring portions 35 are to be deformed outward in the X-direction beyond a predetermined range, then the contact portions 62 are brought into contact with the fixing portions 32 from an inner side of the card edge connector 100 along the X-direction. Thus, the spring portions 35 are prevented from excessively deformed outward. Specifically, each of the regulation portions 60 of this embodiment has a protrusion piece 64 extending toward the housing 20. The protrusion piece 64 of this embodiment is produced by bending a sheet metal about an axis extending substantially in parallel to the X-direction. The protrusion piece 64 extends from the regulation portion 60 in a direction obliquely crossing both of the Y-direction and the Z-direction (i.e., in an oblique upward direction). In this embodiment, a side edge of the protrusion piece 64 near the fixing portion 32 serves as the contact portion 62. With the contact portions 62, even if a relatively large force is applied to the spring portions 35 such that the spring portions 35 are to be deformed outward in the X-direction, the outward deformation of the spring portions 35 can reliably be regulated within the predetermined range by the regulation portions 60. The protrusion pieces 64, for example, may extend in parallel to the XZ-plane.

It is described in detail about the card edge connector 100 with the arm members 30 produced by punching and bending a sheet metal. However, the present invention is not limited to the illustrated example. For example, the arm members 30 may be made of resin or the like. If the arm members 30 are made of resin, the arm members 30 may be formed integrally with the housing 20. In consideration of the strength and the like, it is preferable to use metal for the arm members 30 as in the above embodiment.

According to the present invention, interference portions project inward along a direction in which contacts are arranged (i.e., the width direction of a card) longer than latch portions. Therefore, the latch portions engage with side edges of the card only when the card is properly connected to the card edge connector so that the interference portions do not interfere with the side edges of the card.

The present application is based on a Japanese patent application of JP2009-254987 filed before the Japan Patent Office on Nov. 6, 2009, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A card edge connector comprising:

a plurality of contacts;

a housing configured to hold the plurality of contacts arranged in a first direction; and a pair of arm members held on the housing so as to extend along a second direction perpendicular to the first direction, each of the arm members including a latch portion and an interference portion, wherein:

the latch portion is configured to engage with a side edge of a card when the card is connected to the card edge connector; and the interference portion is configured to interfere with the side edge of the card in the first direction so as to prevent the latch portion from engaging with the side edge of the card when the card is improperly connected to the card edge connector, the interference portion projecting inwardly in the first direction beyond the latch portion;

each of the arm members is produced by punching a sheet metal and bending the punched sheet metal; and the interference portion is produced so as to extend in a third direction perpendicular to both the first direction and the second direction after extending inward in the first direction by bending the punched sheet metal about an axis extending in a direction that is perpendicular to the third direction and is oblique to both of the first direction and the second direction.

2. The card edge connector as recited in claim 1, wherein the latch portion and the interference portion are located at different positions in the second direction.

3. The card edge connector as recited in claim 2, wherein:

the interference portion includes a removal prevention portion on a side edge thereof near the housing;

the removal prevention portion is configured to interfere with the card so as to prevent a forced removal of the card when the card is removed forcibly along the second direction in a state where the card is properly connected to the card edge connector.

4. The card edge connector as recited in claim 2, wherein the each of the arm members further includes:

a fixing portion fixed to a circuit board when the card edge connector is mounted on the circuit board, and a spring portion connected to the fixing portion and formed so that the spring portion can elastically be deformed outward in the first direction, wherein the latch portion and the interference portion project inward along the first direction from the spring portion.

5. The card edge connector as recited in claim 4, wherein:

each of the arm members further includes a regulation portion configured to regulate the outward deformation of the spring portion in the first direction within a predetermined range, the regulation portion including a contact portion on a side edge of the regulation portion facing the fixing portion; and the contact portion is brought into contact with the fixing portion from an inner side of the card edge connector along the first direction so as to prevent excessive deformation of the spring portion when the spring portion is to be deformed outward in the first direction out of the predetermined range.

6. The card edge connector as recited in claim 1, wherein:

the side edge of the card is formed with a notch;

the notch is recessed in the first direction when the card is properly connected to the card edge connector; and the interference portion is located within the notch when the card is properly connected to the card edge connector.

7. A card edge connector comprising:

a plurality of contacts;

a housing configured to hold the plurality of contacts arranged in a first direction; and a pair of arm members held on the housing so as to extend along a second direction perpendicular to the first direction, each of the arm members including a latch portion, an interference portion, a fixing portion and a spring portion, wherein:

the latch portion is configured to engage with a side edge of a card when the card is connected to the card edge connector;

the interference portion is configured to interfere with the side edge of the card in the first direction so as to prevent the latch portion from engaging with the side edge of the card when the card is improperly connected to the card edge connector, the interference portion projecting inwardly in the first direction beyond the latch portion;

the fixing portion is fixed to a circuit board when the card edge connector is mounted on the circuit board;

the spring portion is connected to the fixing portion and is formed so that the spring portion can elastically be deformed outward in the first direction;

the latch portion and the interference portion project inward along the first direction from the spring portion;

the fixing portion and the spring portion include bases extending in parallel to a plane perpendicular to the first direction, respectively; and an upper edge of the base of the spring portion is fixed to an upper edge of the base of the fixing portion.

* * * * *